US006238490B1

(12) United States Patent
Bell et al.

(10) Patent No.: US 6,238,490 B1
(45) Date of Patent: May 29, 2001

(54) PROCESS FOR THE TREATMENT OF AUSTENITIC STAINLESS STEEL ARTICLES

(75) Inventors: Thomas Bell, Merseyside; Yong Sun, Birmingham, both of (GB)

(73) Assignee: The University of Birmingham, Birmingham (GB)

( * ) Notice: Subject to any disclaimer, the term of this patent is extended or adjusted under 35 U.S.C. 154(b) by 0 days.

(21) Appl. No.: 09/463,043

(22) PCT Filed: Jul. 12, 1998

(86) PCT No.: PCT/GB98/02059

§ 371 Date: May 1, 2000

§ 102(e) Date: May 1, 2000

(87) PCT Pub. No.: WO99/04056

PCT Pub. Date: Jan. 28, 1999

(30) Foreign Application Priority Data

Jul. 19, 1997 (GB) ..... 9715180

(51) Int. Cl.[7] ..... C23C 8/36
(52) U.S. Cl. ..... 148/222; 148/225
(58) Field of Search ..... 148/222, 225

(56) References Cited

U.S. PATENT DOCUMENTS

| | | | | |
|---|---|---|---|---|
| 5,383,980 | * | 1/1995 | Melber et al. | 148/222 |
| 5,810,947 | * | 9/1998 | Wu et al. | 148/220 |
| 5,851,313 | * | 12/1998 | Milam | 148/222 |

FOREIGN PATENT DOCUMENTS

| | | | |
|---|---|---|---|
| 294510 | * | 10/1991 | (DE) . |
| 0 801 142 A2 | | 10/1997 | (EP) . |
| 2261227A | | 5/1993 | (GB) . |
| 404026751 | * | 1/1992 | (JP) . |
| 98/12361 | | 3/1998 | (WO) . |

* cited by examiner

*Primary Examiner*—Roy King
*Assistant Examiner*—Nicole Coy
(74) *Attorney, Agent, or Firm*—Ohlandt, Greeley, Ruggiero & Perle, L.L.P.

(57) ABSTRACT

Austenitic stainless steel articles are treated to produce a hardened surface layer thereon by plasma heat-treating the articles at a temperature in the range of 300 to 600° C. and at a pressure in the range of 100 to 1500 Pa in a carbon-containing treatment atmosphere so as to introduce carbon interstitially into the austenite phase in a surface layer on the article.

14 Claims, 4 Drawing Sheets

PROCESS FOR THE TREATMENT OF AUSTENITIC STAINLESS STEEL ARTICLES

This invention relates to a process for the treatment of austenitic stainless steel articles and is more particularly concerned with a process for the treatment of austenitic stainless steel articles so as to produce a hardened surface layer thereon.

BACKGROUND OF THE INVENTION

Austenitic stainless steels have good corrosion resistance in many environmental conditions, but they have low hardness and poor friction and wear properties. Attempts have thus been made to develop surface treatment methods for improving these properties. However, surface modification of austenitic stainless steels usually has to overcome two major problems. One problem is the formation of an oxide scale ($Cr_2O_3$) on the steel surface due to the strong affinity of chromium, which is the principal alloying element in austenitic stainless steels, with oxygen in air. This oxide scale frequently results in poor adhesion between a coating and the steel surface. Therefore, such surface modification techniques as PVD coatings, electroplating and electroless plating have limitations for stainless steels, as compared with coating and plating of most other ferrous alloys.

Another problem associated with surface treatment of austenitic stainless steels lies in the fact that in many cases the improvement in surface hardness and wear resistance of the steels by surface treatments is accompanied by a loss in the corrosion resistance. For example, plasma nitriding, which is carried out in a glow discharge in a nitrogen gas-containing mixture at a pressure of 100 to 1000 Pa (1 to 10 mbar), is one of the most widely used methods to treat stainless steel surfaces, resulting in a nitrogen diffusion layer having high hardness and excellent wear resistance. However, nitriding hardening is induced by the precipitation of chromium nitrides in the nitrided layer. This leads to a depletion of chromium in the austenite matrix and thus a significant reduction in corrosion resistance [see E. Rolinski, "Effect of Plasma Nitriding Temperature on Surface Properties of Austenitic Stainless Steel", *Surface Engineering,* Vol. 3, No. 1. 1987, pages 35–40].

Therefore, attempts have been made to develop surface treatment methods for improving the wear resistance of austenitic stainless steels without losing their corrosion resistance. A low temperature plasma nitriding technique has been developed, in which a conventional dc or pulsed plasma nitriding apparatus is used. The process is carried out at temperatures below 500° C. for a time up to 60 hours in a nitrogen-containing gas of pressure 100 to 1000 Pa(1 to 10 mbar) [see P. A. Deamley, A. Namvar, G. G. A Hibberd and T. Bell, "Some Observations on Plasma Nitriding Austenitic Stainless Steel", *Proceedings of the First International Conference on Plasma Surface Engineering,* Garmisch-Partenkirchen, Germany, 1989, pages 219–226.] Low temperature nitriding can produce a nitrided layer having high hardness and good corrosion resistance. However, the hardened layer is very thin and brittle, and it is difficult to achieve uniform layer thickness.

A low pressure plasma carbon diffusion treatment has recently been proposed for stainless steels, in which a triode ion plating apparatus is used and the treatment is carried out at temperatures between 320° C. and 350° C. and in a gas mixture of argon, hydrogen and methane [see P. Stevenson, A. Leyland. M. Parkin and A. Matthews, "Effect of Process Parameters on the Plasma Carbon Diffusion Treatment of Stainless Steels at Low Pressure", *Surface and Coatings Technology,* Vol. 63, 1994, pages 135–143.] A working pressure of 1 to 2 Pa (0.01 to 0.02 mbar) is used for the treatment, which requires the use of a diffusion pump throughout the treatment lasting up to 30 hours. An additional sputter cleaning stage of several hours is required to effect carbon mass transfer and diffusion. A typical process comprises 4 hours sputter cleaning in argon or argon and hydrogen mixture, followed by 20 hours treatment at 320–350° C., producing a carburised layer of 11 $\mu$m thick with a maximum hardness about 7000 $MN/mm^2$(700 $HV_{0.01}$). No corrosion test results are reported for this treatment The low pressure plasma carbon diffusion treatment uses an expensive and complicated triode ion plating system, and requires operation of the diffusion pump throughout the process and an additional sputter cleaning step. In addition, the growth rate and hardening response of the layer are low. Similar comments apply also to the procedures described in GB-A-2261227.

K. T. Rie et al (Haerterie-Technische Mitteilungen, vol 42, No. 6, Nov. 1, 1987, pages 338–343) disclose plasma nitriding and plasma nitrocarburising procedures conducted so as to produce a compound layer on sintered mild steel, which has a body-centred cubic structure. In contrast to this, the present invention is concerned with austenitic stainless steels which have a face-centred cubic structure.

Th. Lampe et al (Haerterie-Technische Mitteilungen vol 46, No. 5, September 1991, pages 308–316) disclose plasma nitriding and plasma nitrocarburising procedures conducted so as to form a compound layer on iron-based material such as sintered mild steel, ledeburitic cast iron and pearlitic cast iron which, like the mild steel of K. T. Rie et al (supra), has a body-centred cubic structure.

G. V. Shcherbedinskii et al (Metal Science and Heat Treatment, 34 (1992) May/June, Nos. 5/6, pages 375–378) also disclose a procedure for the plasma nitrocarburising of high speed steels using dicyanogen formed in situ by decomposition of ferrocyanides.

SUMMARY OF THE INVENTION

It is an object of the present invention to provide an improved method of treatment of austenitic stainless steel articles which can enable the above-mentioned disadvantages to be obviated or mitigated. In particular, it is an object of the present invention to provide a treatment process which is relatively cost-effective and which is capable of forming, at a relatively low temperature, a corrosion-resistant hardened surface layer with high ductility and uniform thickness on austenitic stainless steel articles, so as to provide such articles with enhanced wear resistance without adversely affecting the corrosion resistance to an undue extent.

According to the present- invention, there-is-provided a process for the treatment of an austenitic stainless steel article, comprising the step of plasma heat-treating the article at a temperature in the range of 300 to 600° C. for 0.1 to 100 hours and at a pressure in the range of 100 to 1500 Pa in a carbon-containing treatment atmosphere so as to introduce carbon interstitially into the austenite phase in a surface layer on the article.

The resultant hardened layer comprises expanded austenite supersaturated with carbon.

The heat-treatment temperature is preferably in the range of 350 to 540° C., and is typically about 450 to 500° C.

The heat treatment is typically carried out at a pressure of about 500 Pa (about 5 mbar). The time for treatment depends upon the temperature, the carbon-activity of the atmosphere, the pressure and the required depth for the hardened surface layer (which may be in the range of 5 to 50 $\mu$m), and varies from 0.1 to 100 hours. For reasons of economy and efficiency, a treatment time of 3 to 40 hours is preferred.

The treatment atmosphere may be a gas mixture comprising at least one carbon-containing gas such as methane, carbon dioxide, carbon monoxide or other C—H organic gases or vapours with at least one relatively inert gas such as hydrogen, argon or rare gas such as helium.

It is also within the scope of the present invention for nitrogen to be introduced into the surface layer, provided that carbon is dominant in interstitial solid solution. Where nitrogen is also to be in into the surface layer, this may be provided by nitrogen gas or ammonia in the gas mixture.

A gas mixture of hydrogen with methane or hydrogen and argon with methane, with the composition of methane in the range of 0.5 to 20% by volume is preferred for carbon diffusion, and the above gas mixtures with 0.5% to 10% nitrogen or ammonia is preferred for carbon and nitrogen diffusion together.

In the case where both carbon and nitrogen are present in the treatment atmosphere, the treatment temperature is generally in the range of 300 to 500° C.

During the plasma heat treatment, the carbon-containing gases are ionised, activated and dissociated to produce carbon ions and activated carbon atoms and neutral molecules, which then diffuse into the surface of the article forming a carbon diffusion layer. Due to the relatively low temperatures employed in the treatment, the carbon atoms mainly reside in the austenite lattices, forming a solid solution and thus a layer of expanded austenite with a possible nanocrystalline/amorphous structure. The resultant layer has a high hardness, good ductility and excellent wear and corrosion resistance. In the case where nitrogen is added to the carbon-containing mixture, both carbon and nitrogen diffuse into the surface of the article, forming a hardened layer-alloyed with both carbon and nitrogen, but with carbon being the dominant species.

Most preferably, heating of the article is effected in the absence of oxygen. In order to exclude oxygen before the article is heated, it is preferred to reduce the pressure in the sealed vessel to 10 Pa (0.1 mbar) or less. The use of a rotary pump is generally suitable-for this purpose. However, a diffusion pump may be used-if desired.

To heat the article to the required treatment temperature, a heating gas or gas mixture may be introduced into the sealed vessel and heating effected by electrical glow discharge. Alternatively, an external heater-attached to the vessel may be employed, or a combination of external heating and electrical glow discharge heating may be employed. Direct current (dc) discharge, pulsed dc discharge or alternating current (ac) discharge may be used. In dc glow discharge, the article to be treated serves as the cathode and the vessel itself or an additional electrode provided in the vessel serves as the anode. During the heating step, the pressure in the sealed vessel, may be gradually increased from 10 Pa (0.1 mbar) or less to the final working pressure at which heat treatment takes place.

Between the heating step and the treatment step, a sputter-cleaning step may be performed. This cleaning step helps to remove any oxide scale on the surface of the article by bombardment of the surface with positive ions in the plasma. Sputter cleaning may be performed in argon, hydrogen or a rare gas such as helium, or by a combination of these gases, at or below the treatment temperature. The sputter-cleaning step may be effected for up to 5 hours.

After completion of the heat treatment step, the article is allowed to cool. A wide range of cooling rates are possible, eg. from 0.1° C./min to 1000° C./min. Thus, cooling may be effected by slow cooling in the sealed vessel under the treatment atmosphere or by fast cooling by quenching in a fluid. However, in order to minimise dimension distortion, to prevent oxidation of the surface and to eliminate the extra costs of incorporating a fast cooling system in the apparatus, cooling in the sealed vessel is preferred. After the article has cooled down to 100° C. or below, it can be removed from the vessel and is then ready for use.

The composition of the austenitic stainless steel of which the article is formed is not particularly critical. Any austenitic stainless steel composition may be employed provided that the austenite-stabilising elements (usually nickel and/or manganese) are present in sufficient quantities to give a face-centred-cubic structure and that chromium is present in sufficient quantity to give corrosion resistance. For example, the austenite-stabilising elements may be present in an amount of 6 to 30 wt % of the alloy. Chromium may be present in the range of 16 to 26 wt %. Any one or more of the usual alloying ingredients may be included, for example any one or more of molybdenum, titanium, niobium, nitrogen, vanadium, sodium and copper. Additionally, carbon in an amount of less than 0.2% by weight may be present in the austenitic stainless steel of which the article is formed, ie. in the austenitic stainless steel before the heat treatment process according to the present invention.

Typical examples of suitable austenitic stainless steels which are susceptible to the process of the present invention are stainless steels 316 (16–18Cr, 10–14Ni, 0.08C, 2.0 Mn, 2–3Mo), 304 (18–20Cr, 8–10Ni, 0.08C, 2.0 Mn) and 321 (17–19Cr, 9–12Ni, 0.08C, 2.0Mn, 0.3–1.0Ti) The stainless steel alloy of which the article is formed may be in the annealed, solution-treated or work-hardened form before the article is subjected to the process according to the present invention.

The surface-treatment-process can be applied as a final procedure without causing deterioration of the properties of the substrate or dimensional distortion of the article. Articles for which the process of the present invention is suitable include such articles as ferrules, valves, gears and shafts. There is no particular limit in the size of articles that can be treated using the process of the present invention. Articles which are several metres long and several metres in diameter in principle can be treated using the process of the present invention.

DETAILED DESCRIPTION

The present invention will now be described in further detail in the following Examples:

EXAMPLE 1

Figure 1:
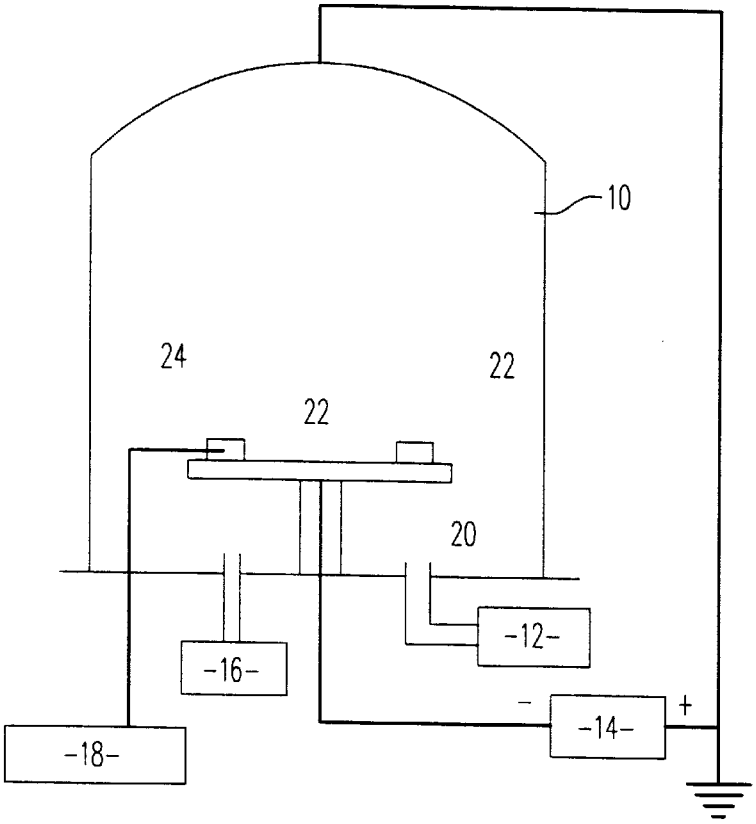
FIG. 1 is a schematic view of a dc plasma nitriding apparatus in which the treatment process described in Example 1 below was effected.
Figure 2:
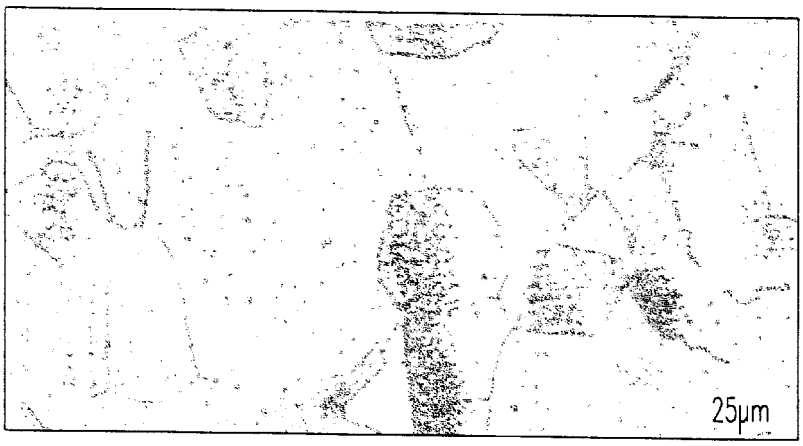
FIG. 2 is an optical micrograph showing the hardened layer, after etching in 50 HCl+25 $HNO_3$+25 $H_2O$ solution, on the surface of an article treated as described in Example 1 below, the hardness impressions indicating the hardness of the layer.
Figure 3:
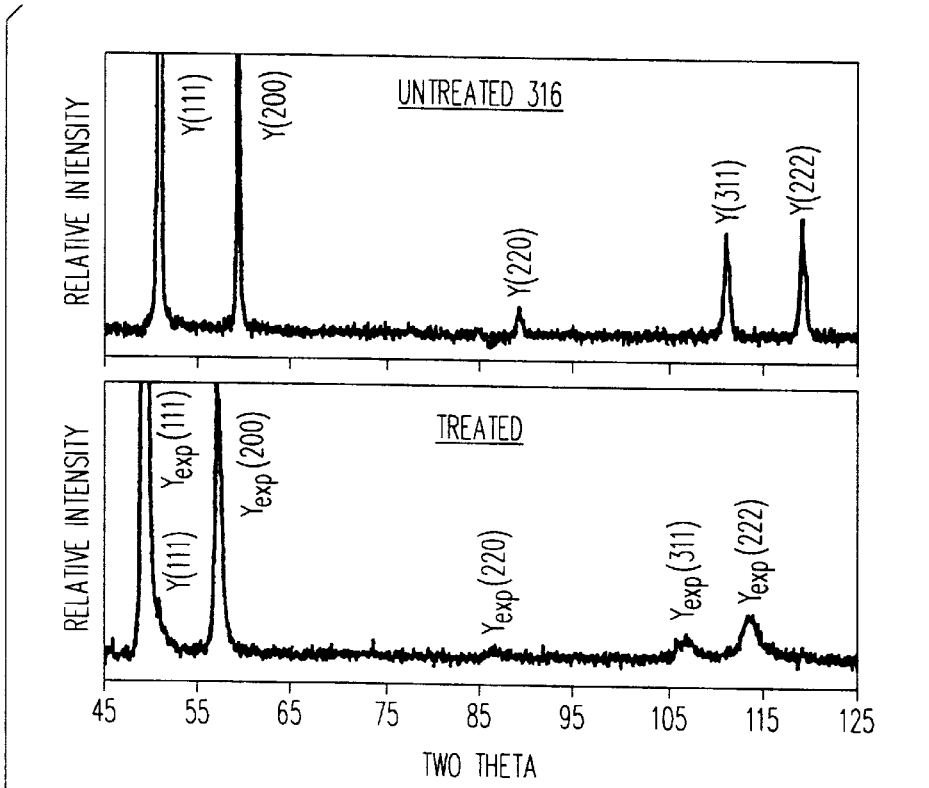
FIG. 3 are typical X-ray diffraction patterns of the surface layer of an article before and after treatment as described in Example 1 below, showing that, after treatment, the surface layer consists predominantly of a precipitation-free expanded austenite.
Figure 4:
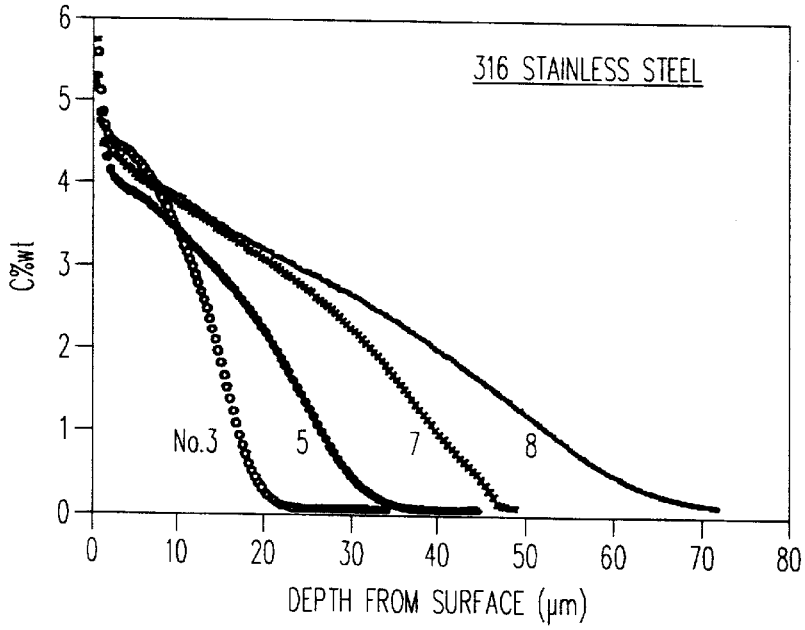
FIG. 4 is a graph plotting carbon concentration in wt % against depth from the surface obtained by glow discharge spectrometry (GDS) analysis performed on a typical article treated as. described in Example 1 below.
Figure 5:
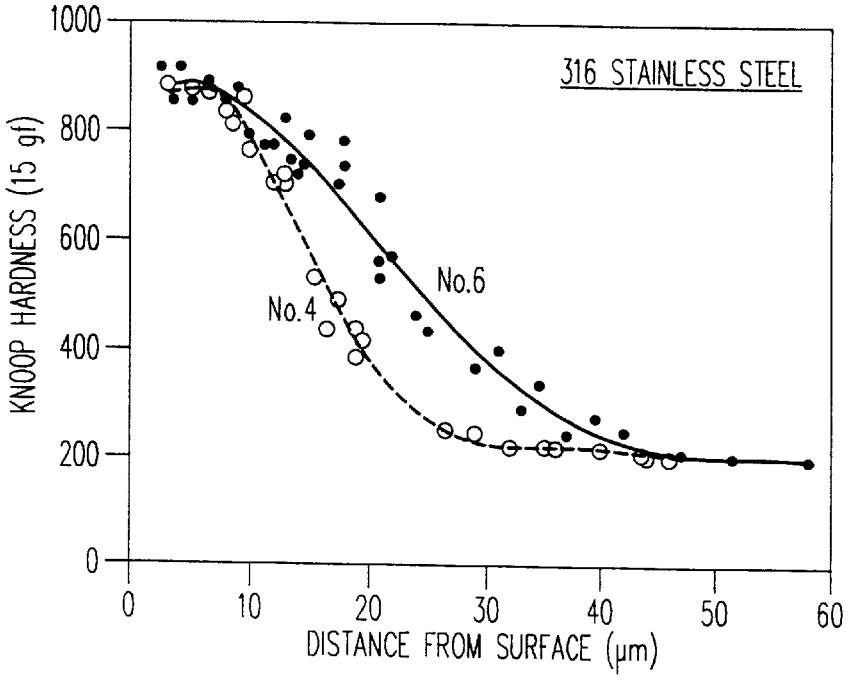
FIG. 5 is a graph plotting Knoop Hardness (15 gf) against depth from the surface obtained from typical articles treated as described in Example 1 below, showing diffuse-type hardness profiles.

In this Example, surface treatment was carried out using the dc plasma nitriding apparatus shown in FIG. 1. This apparatus comprises a sealed vessel 10, a vacuum system 12 with a rotary pump (not shown), a dc power supply and control unit 14, a gas supply system 16, a temperature measurement and control system 18, and a work table 20 for supporting articles 22 to be treated.

In this example, the articles to be treated were 316 type austenitic stainless steel discs 25 mm in diameter and 8 mm in thickness. The discs to be treated were placed on the table 20 inside the vessel 10. The table 20 was connected as a cathode to the unit 14, and the wall of the vessel 10 was connected to the dc source as the anode. The temperature of the discs 22 was measured by a thermocouple 24 inserted into a hole of 3 mm diameter drilled in one of the discs 22 or a dummy sample. After the sealed vessel 10 was tightly closed, the rotary pump was used to remove the residual air and thus reduce the pressure in the vessel. When the reduction in pressure reached 10 Pa (0.1 mbar) or below, a glow discharge was introduced between the article 22. (cathode) and the vessel wall (anode) by applying a voltage of 400 volts to 900 volts between these two electrodes. A heating gas of hydrogen was at the same time introduced into the vessel 10. The pressure of the hydrogen gas in the vessel 10 was increased gradually as the temperature of the articles 22 increased. No external or auxiliary heating was employed, and the articles 22 were heated by the glow discharge only.

After the articles 22 were heated up to the prescribed temperature, a gas mixture of hydrogen and methane was introduced into the vessel 10 and the treatment step started. No additional sputter cleaning step was used in this Example. Treatment temperatures from 350° C. to 600° C. were employed for treatment times from 3 hours to 20 hours. The working pressure in the treatment step was 500 Pa (5.0 mbar) for all the experiments in this Example.

After the completion of the treatment step, the glow discharge was turned off and the articles 22 were allowed to cool in the vessel 10 in the treatment atmosphere down to room temperature before they were removed from the vessel.

Then, the articles 22 were subjected to X-ray diffraction analysis for phase identification, glow discharge spectrometry (GDS) analysis for chemical composition determination, surface hardness measurements and metallography analysis of the cross section for thickness measurements and hardness profile measurements. The results are shown in Table 1 and FIGS. 2 to 5. It is thus confirmed that surface treatment at temperatures between 300° C. and 600° C. can produce a "white" (corrosion resistant) layer on 316type austenitic stainless steel. The layer is enriched with carbon, has a high surface hardness and a diffuse-type hardness profile, and comprises an expanded austenite with a possible nanocrystalline/amorphous structure.

Indentation, scratch and simple bending tests were conducted to assess the ductility and bonding strength of the hardened surface layer. No cracks or debonding of this layer were observed during these tests and the hardened layer was found to deform with the substrate, thus confirming that the layer has good ductility.

TABLE 1

Summary of layer thickness and surface hardness values of 316 steel

| No. | Temperature (° C.) | Time (h) | Thickness (μm) | Surface Hardness ($HV_{0.05}$) |
|---|---|---|---|---|
| 1 | 350 | 15 | 6 | 668 |
| 2 | 400 | 15 | 15 | 846 |
| 3 | 450 | 5 | 13 | 859 |
| 4 | 450 | 15 | 25 | 1039 |
| 5 | 500 | 3 | 18 | 965 |
| 6 | 500 | 15 | 35 | 1135 |
| 7 | 550 | 3 | 31 | 1061 |
| 8 | 600 | 3 | 45 | 937 |
| 9 | 520 | 6 | 27 | 1050 |
| 10 | 520 | 12 | 40 | 1103 |
| 11 | 520 | 20 | 50 | 1103 |

EXAMPLE 2

The surface treatment conditions in Example 2 were similar to those in Example 1. In Example 2, in addition to 316 steel, discs formed of other grades of austenitic stainless steel were used as articles to be treated. Accordingly, discs of 25 mm in diameter and 8 mm in thickness were prepared from 304, 321 and 316 austenitic stainless steels. Following the process procedures outlined in Example 1, the articles were treated at 440° C. and 520° C. for 12 hours. After the treatment, the articles were analysed using the techniques outlined in Example 1. It was confirmed that hardened layer of expanded austenite enriched with carbon can be formed in all types of austenitic stainless steel. Table 2 summarises the thickness and surface hardness values of the layers formed.

TABLE 2

Layer thickness and surface hardness values of 316, 304 and 321 steels

| No. | Material | Temperature (° C.) | Time (h) | Thickness (μm) | Surface Hardness ($HV_{0.05}$) |
|---|---|---|---|---|---|
| 12 | 316 | 440 | 12 | 20 | 998 |
| 13 | 304 | 440 | 12 | 13 | 845 |
| 14 | 321 | 440 | 12 | 15 | 921 |
| 15 | 316 | 520 | 12 | 40 | 1103 |
| 16 | 304 | 520 | 12 | 33 | 983 |
| 17 | 321 | 520 | 12 | 35 | 1049 |

EXAMPLE 3

Discs formed of 316 type austenitic stainless steel were used as the articles to be treated in this Example. Two sets experiments were performed which were different from those in Example 1. Firstly, various heating gases and gas mixtures were used in the heating step. These included hydrogen, argon, a mixture of hydrogen and argon and a mixture of hydrogen and methane. Secondly, various carbon-containing treatment atmospheres were used in the treatment step, and these included a mixture of hydrogen and methane, a mixture of hydrogen, argon and methane, and a mixture of hydrogen and carbon dioxide ($CO_2$). Following the process procedure outlined in Example 1, the articles were treated in these heating gases and treatment atmospheres at 500° C. for 3 hours. The obtained results are shown in Table 3 in terms of layer thickness and surface hardness. It can be seen that a hardened layer can be formed in various combinations of heating gases and treatment atmospheres.

TABLE 3

Layer thickness and surface hardness values of 316 steel

| No. | Heating Gases | Treatment Gases | T(° C.)/t(h) | Thickness (μm) | Hardness ($HV_{0.05}$) |
|---|---|---|---|---|---|
| 18 | $H_2$ | $H_2 + CH_4$ | 500/3 | 18 | 965 |
| 19 | Ar | $H_2 + CH_4$ | 500/3 | 16 | 925 |
| 20 | $H_2$ + Ar | $H_2 + CH_4$ | 50O/3 | 18 | 950 |
| 21 | $H_2 + CH_4$ | $H_2 + CH_4$ | 500/3 | 20 | 1003 |
| 22 | $H_2$ | $H_2$ + Ar + $CH_4$ | 500/3 | 17 | 980 |
| 23 | $H_2$ | $H_2 + CO_2$ | 500/3 | 15 | 849 |

EXAMPLE 4

In Example 4, the process conditions were similar to those used in Example 1, except that nitrogen gas was added to the treatment atmosphere in the treatment step. Discs of 316type austenitic stainless steel were used as the articles to be treated in Example 4. The articles were treated at 450° and 500° C. for 3 hours. Two levels of nitrogen gas were introduced to the treatment atmosphere, i.e. 2.0% at 450° C. and 5% at 500°C. The treated articles were analysed using the techniques used in Example 1. Table 4 shows the thickness and hardness values of the layers produced. It was confirmed that the addition of nitrogen to the treatment atmosphere can also result in a thick and hard layer, which also appears "white" after etching. GDS composition profile analysis revealed that both carbon and nitrogen were incorporated in the layer.

TABLE 4

Layer thickness and surface hardness values of 316 steel

| No. | Treatment Gases | T(° C.)/t(h) | Thickness (μm) | Hardness ($HV_{0.05}$) |
|---|---|---|---|---|
| 24 | $H_2 + CH_4$ | 450/3 | 11 | 854 |
| 25 | $H_2 + CH_4$ + 2% $N_2$ | 450/3 | 13 | 1022 |
| 26 | $H_2 + CH_4$ | 500/3 | 18 | 965 |
| 27 | $H_2 + CH_4$ + 5% $N_2$ | 500/3 | 25 | 1280 |

EXAMPLE 5

In Example 5, wear testing and corrosion testing specimens made from 316-type austenitic stainless steel were treated under conditions similar to those used in Example 1. Table 5 lists the treatment conditions used and the resultant layer thickness.

TABLE 5

Treatments for wear and corrosion tests

| No. | Temperature (° C.) | Time (h) | Thickness (μm) | Tests |
|---|---|---|---|---|
| 28 | 400 | 15 | 15 | corrosion |
| 29 | 450 | 15 | 25 | wear |
| 30 | 500 | 3 | 18 | wear |
| 31 | 500 | 5 | 22 | corrosion |
| 32 | 500 | 20 | 40 | wear, corrosion |

Figure 6:
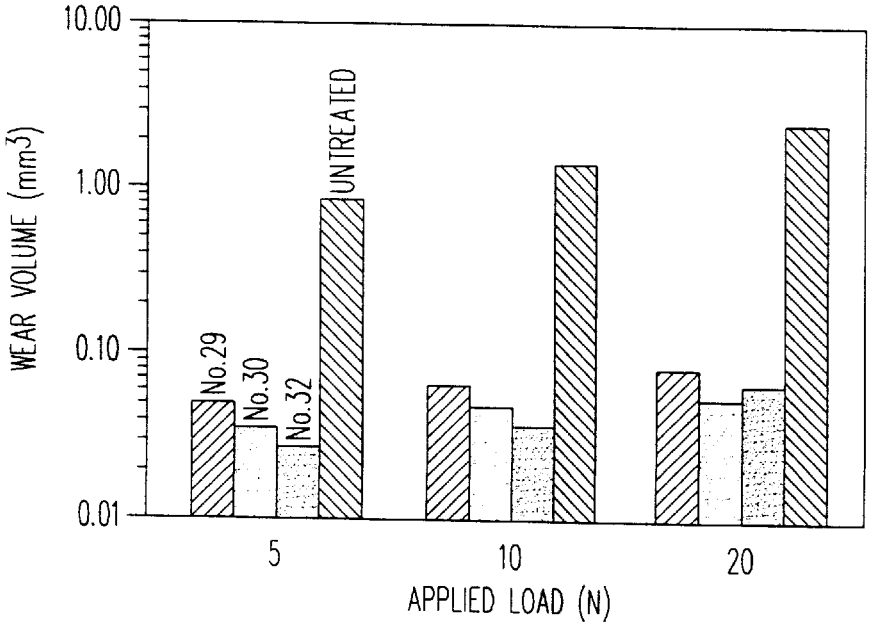
FIG. 6 is a bar chart showing sliding wear test results obtained from sliding wear tests using dry, bearing steel balls on untreated articles and articles treated as described in Example 5 below.

Were testing was carried out using a pin-on-disc machine under unlubricated pure sliding conditions. A hardened bearing steel ball of 5 mm in diameter was used as the slider (pin). Three different normal loads were used for the tests. The results are given in FIG. 6. which shows that surface treatment under a variety of different conditions can significantly improve the sliding wear resistance of the austenitic stainless steel by up to 20 times under the present testing conditions. In addition, the treated specimens showed a stable friction coefficient of 0.73, whilst the untreated specimen showed a large scatter in friction coefficient which averaged 0.80.

Figure 7:
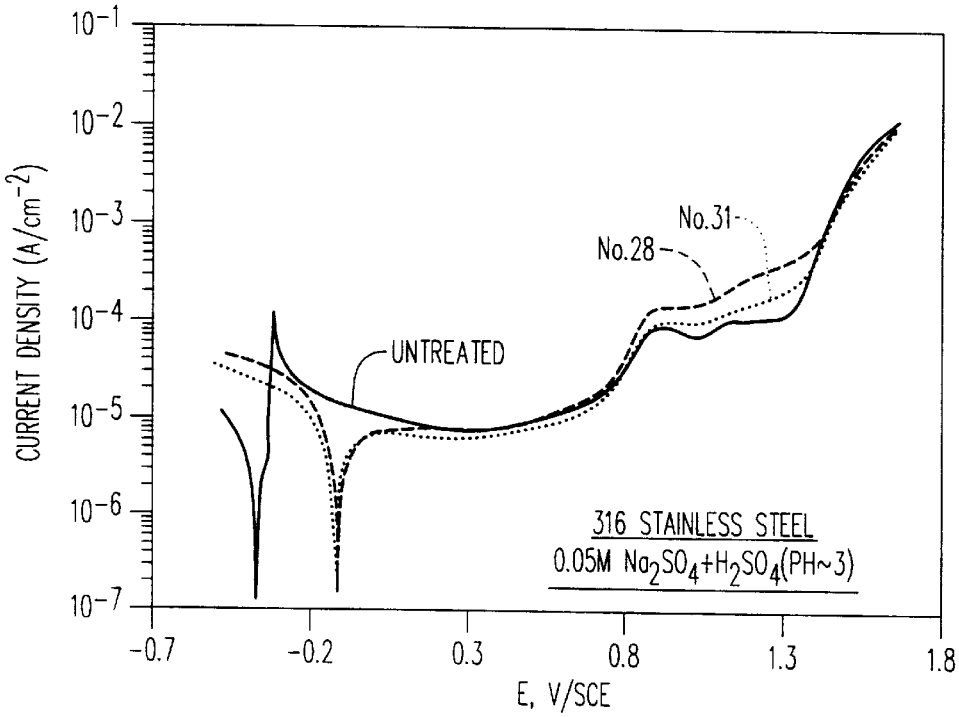
FIG. 7 is a graph showing anodic polarisation curves measured in 0.05M $Na_2SO_4$ solution for an untreated article and articles treated as described in Example 5 below.
Figure 8:
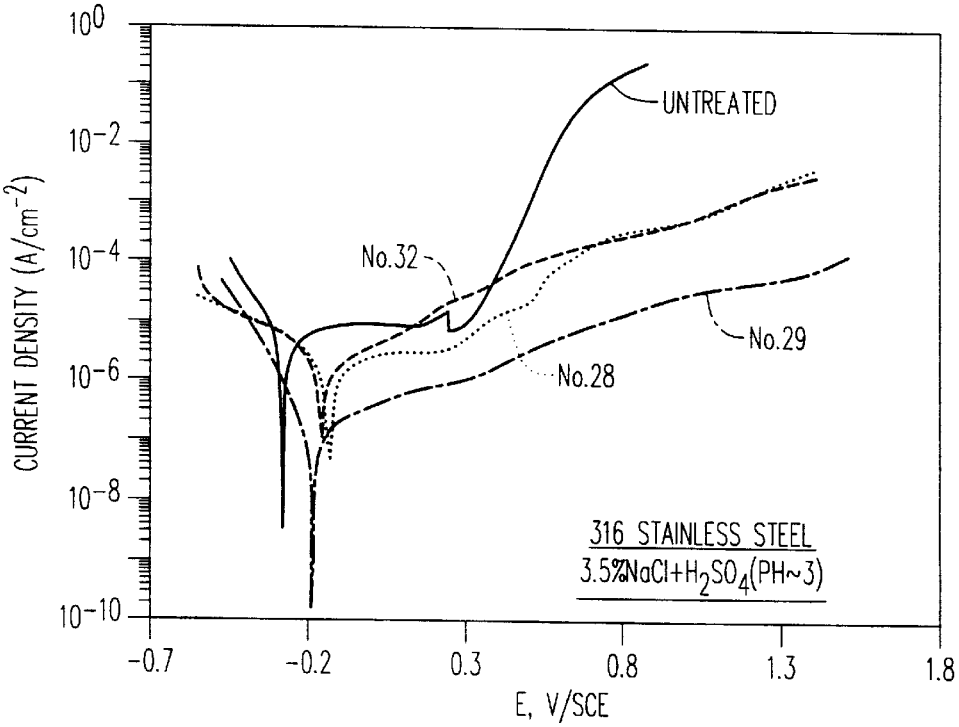
FIG. 8 is a graph showing anodic polarisation curves measured in 3.5% NaCl solution for an untreated article and articles treated as described in Example 5 below.

Corrosion testing was carried out using the electrochemical testing technique in 3.5% sodium chloride (NaCl) and 0.05 M $Na_2SO_4$ solutions. The test results are presented in FIGS. 7 and 8. For comparison purpose, the untreated article was also tested. It can be seen that, in the $Na_2SO_4$ solution, both untreated and treated articles showed excellent corrosion resistance; no significant difference in corrosion current density was observed between different samples; however, the treated samples exhibited a shift of the corrosion potential towards the positive (passive) side, indicating improvement in corrosion behaviour.

In the NaCl solution, the treated articles showed a much improved corrosion behaviour, particularly pitting resistance. The untreated article was subjected to pitting corrosion when the potential reached 0.4 V/SCE or above, resulting in a dramatic increase in current density. In the treated articles, no pitting has been observed even after testing up to 1.5 V/SCE, indicating an improvement in pitting potential for at least 4 times. In this solution, the treated article exhibited a general corrosion behaviour, ie. the corrosion rate increases slowly with increasing potential.

Further corrosion testing was performed on the article treated at 500° C. for 5 hours after the surface hardened layer had been completely removed by grinding, with the purpose to assess the effect of surface treatment on the corrosion behaviour of the substrate. Tests performed in both NaCl and $Na_2SO_4$ solutions indicated that the treatment has negligible influence on the corrosion behaviour of the substrate.

What is claimed is:

1. A process for the treatment of an austenitic stainless steel article, comprising the step of plasma heat-treating the article at a temperature in the range of 300 to 600° C. for 0.1 to 100 hours and at a pressure in the range of 100 to 1500 Pa in a carbon-containing treatment atmosphere so as to introduce carbon interstitially into the austenite phase in a surface layer on the article.

2. A process as claimed in claim 1, wherein the heat-treating temperature is in the range of 350 to 540° C.

3. A process as claimed in claim 1, wherein the heat-treating temperature is about 450 to 500° C.

4. A process as claimed in claim 1, wherein the heat-treating time is 3 to 40 hours.

5. A process as claimed in claim 1, wherein the heat-treating is performed so as to produce a hardened surface layer having a thickness in the range of 5 to 50 $\mu$m.

6. A process as claimed in claim 1, wherein the heat-treating is effected in an atmosphere comprising at least one carbon-containing gas and at least one inert gas.

7. A process as claimed in claim 6, wherein the atmosphere comprises a gas mixture of hydrogen with methane, or hydrogen and argon with methane, with the composition of methane being in the range of 0.5 to 20% by volume.

8. A process as claimed in claim 1, wherein the heat-treating is effected in an atmosphere which also contains nitrogen so that nitrogen is introduced into the surface layer whilst ensuring that carbon is dominant in interstitial solid solution.

9. A process as claimed in claim 8, wherein the atmosphere contains 0.5% to 10% by volume of nitrogen or ammonia.

10. A process as claimed in claim 8, wherein the heat-treating temperature is in the range of 300 to 500° C.

11. A process as claimed in claim 1, wherein the heat-treating is effected essentially in the absence of oxygen.

12. A process as claimed in claim 11, wherein prior to effecting the heat-treatment, the pressure is reduced to 10 Pa or less.

13. A process as claimed in claim 1, wherein the article is heated to the required heat-treating temperature prior to exposing the article to the carbon-containing atmosphere.

14. A process as claimed in claim 13, wherein between the heating step and the heat-treating step, a sputter-cleaning step is performed.

* * * * *